US010520138B2

(12) United States Patent
Lin et al.

(10) Patent No.: US 10,520,138 B2
(45) Date of Patent: Dec. 31, 2019

(54) LIGHT BULB WITH FIXED STRUCTURE

(71) Applicant: LEEDARSON LIGHTING FIXTURES CO., LTD, Fujian (CN)

(72) Inventors: Chengju Lin, Xiamen (CN); Fangwei Wei, Xiamen (CN); Liangliang Cao, Xiamen (CN)

(73) Assignee: Xiamen Eco Lighting Co., Ltd., Xiamen (CN)

( * ) Notice: Subject to any disclaimer, the term of this patent is extended or adjusted under 35 U.S.C. 154(b) by 0 days.

(21) Appl. No.: 15/508,490

(22) PCT Filed: Jul. 28, 2016

(86) PCT No.: PCT/CN2016/091998
§ 371 (c)(1),
(2) Date: Mar. 3, 2017

(87) PCT Pub. No.: WO2017/067266
PCT Pub. Date: Apr. 27, 2017

(65) Prior Publication Data

US 2017/0284608 A1 Oct. 5, 2017

(30) Foreign Application Priority Data

Oct. 20, 2015 (CN) ..... 2015 1 0681510

(51) Int. Cl.

| | |
|---|---|
| ***F21K 9/237*** | (2016.01) |
| ***F21V 17/10*** | (2006.01) |
| ***F21K 9/232*** | (2016.01) |
| ***F21V 3/02*** | (2006.01) |
| ***F21V 7/04*** | (2006.01) |
| ***F21V 19/00*** | (2006.01) |

(Continued)

(52) U.S. Cl.
CPC ..... *F21K 9/237* (2016.08); *F21K 9/232* (2016.08); *F21K 9/68* (2016.08); *F21V 3/02* (2013.01); *F21V 7/04* (2013.01); *F21V 17/10* (2013.01); *F21V 19/003* (2013.01); *F21Y 2105/18* (2016.08); *F21Y 2115/10* (2016.08)

(58) Field of Classification Search
CPC . F21K 9/237; F21K 9/232; F21K 9/68; F21V 3/02; F21V 7/04; F21V 17/10; F21V 19/003; F21Y 2105/18; F21Y 2115/10
USPC ..... 362/296.05
See application file for complete search history.

(56) References Cited

U.S. PATENT DOCUMENTS

2010/0289396 A1* 11/2010 Osawa ..... F21V 3/00 313/46
2012/0049737 A1* 3/2012 Kitagawa ..... F21V 17/101 315/53

* cited by examiner

*Primary Examiner* — Anh T Mai
*Assistant Examiner* — Hana S Featherly
(74) *Attorney, Agent, or Firm* — Chun-Ming Shih; Lanway IPR Services

(57) ABSTRACT

A light allocation item is set on a light source board to change the spread of the light comes out from the light source board. A light bulb shell shade is set around the light source board and the light allocation item. A bottom edge is set on the opening site of the bottom of the light bulb shell. The bottom edge is set around the light source board. A pressed device is set on light allocation item. The pressed device or the bottom edge is made of the elastic ingredients. The pressed device reaches to outside of the light source board to press the bottom edge of the light bulb shell. Setting the pressed device on the light allocation item makes the pressed device reach outside of the light source board. Therefore, the pressed device sets the bottom of the light bulb shell elastically to realize the fix.

8 Claims, 3 Drawing Sheets

(51) Int. Cl.

| | |
|---|---|
| ***F21K 9/68*** | (2016.01) |
| *F21Y 115/10* | (2016.01) |
| *F21Y 105/18* | (2016.01) |

LIGHT BULB WITH FIXED STRUCTURE

TECHNICAL FIELD

The present invention is related to an LED lighting device and more particularly related to a fixed structure of the light bulb shell.

BACKGROUND

An LED light source owns the advantages of a high lighting efficiency, low radiation, low-battery usage and long lifetime. Therefore, the LED light is used more and more widely. The LED light replaces the traditional lighting devices like an incandescent lamp and a halogen lamp. In todays technology, the fix of a bulb shell commonly uses the way of gluing. However, having the pressure on the cost recently, the market gradually appears a variety of the buckle installation methods. In all the methods, buckling the bulb shell on the heat dissipation device and through the bulb pins to buckle on the heat dissipation device is the general way. This buckle method always exists the problem of insufficient strength and easily fallen. Requiring the coated adhesive realizes the fix of the bulb shell. Coated adhesive is not only disadvantage of environmental protection, but also for the professional gluing process. The installation process is complex.

SUMMARY OF INVENTION

In view of this, it is necessary to provide the fixed structure of the light bulb shell with an automated installation.

A fixed structure of the light bulb shell includes a light source board, a light allocation item and a light bulb shell. The light allocation item is set on the light source board to change the spread of the light comes out from the light source board. The light bulb shell shade is set around the light source board and the light allocation item. The bottom edge is set on the opening site of the bottom of the light bulb shell. The bottom edge is set around the light source board. The pressed device is set on light allocation item. The pressed device or the bottom edge is made of the elastic ingredients. The pressed device reaches to outside of the light source board to press the bottom edge of the light bulb shell.

Comparing with the existed technology, the light bulb shell fixed structure sets the bottom edge through the bottom of the light bulb shell. Setting the pressed device on the light allocation item makes the pressed device reach outside of the light source board. Therefore, the pressed device sets the bottom of the light bulb shell elastically to realize the fix. Because save the gluing process makes the light bulb shell own the advantage of firm installation and easily to be automated installation.

DETAILED DESCRIPTION

Though the attached drawing and the embodiment to describe the present invention detailed in following statement.

Figure 1:
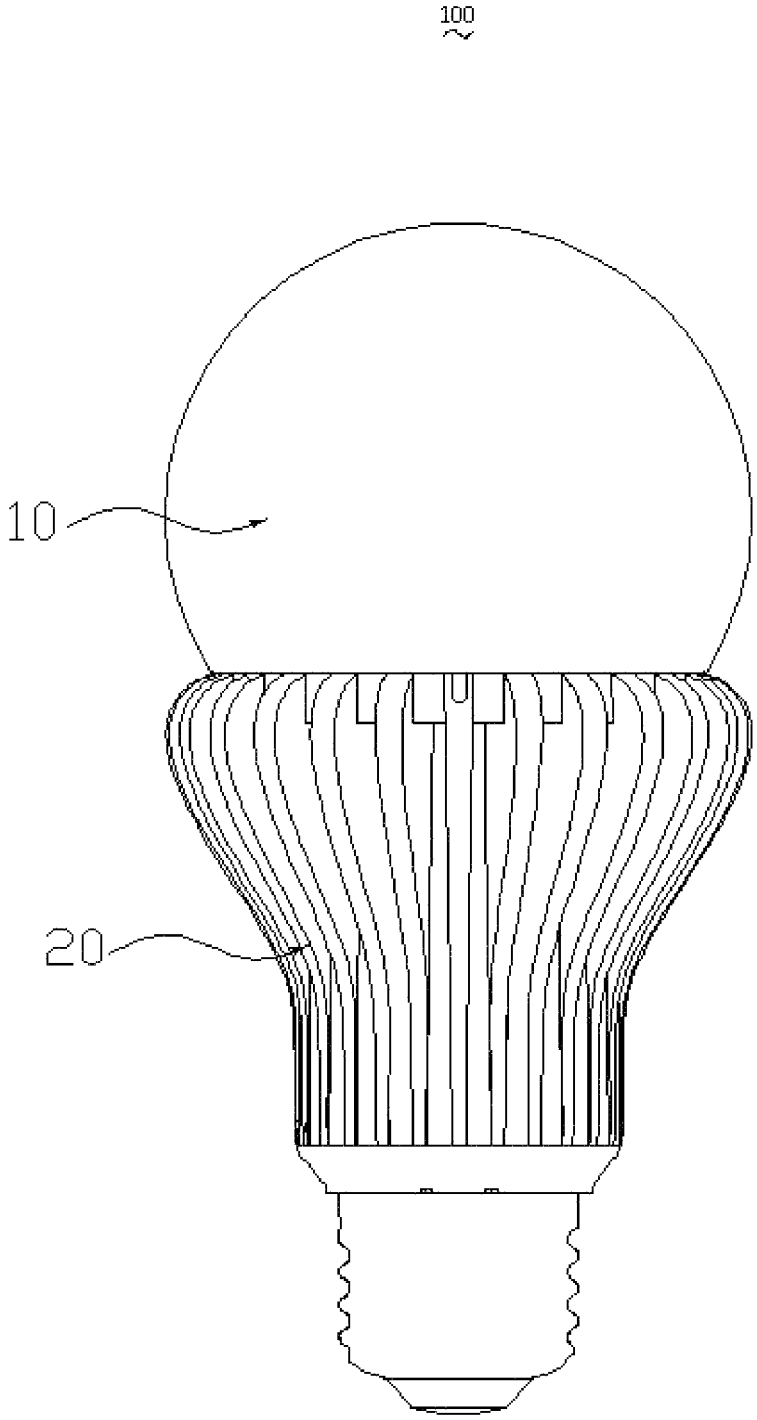
FIG. 1 is the first embodiment main drawing for the present invention, the fixed structure of the light bulb shell.
Figure 2:
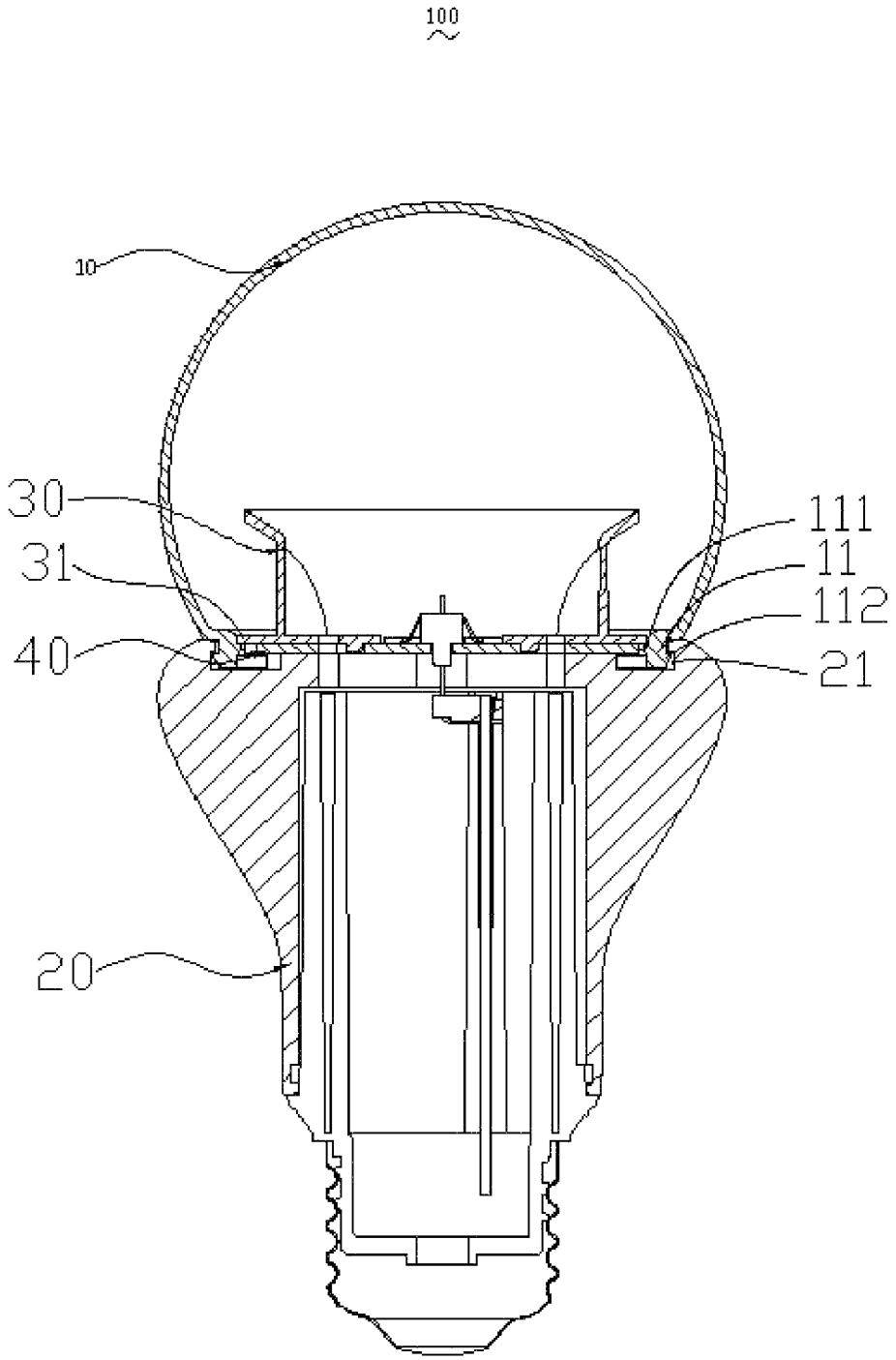
FIG. 2 is the main sectional drawing from FIG. 1 that illustrates the fixed structure of the light bulb shell.
Figure 3:
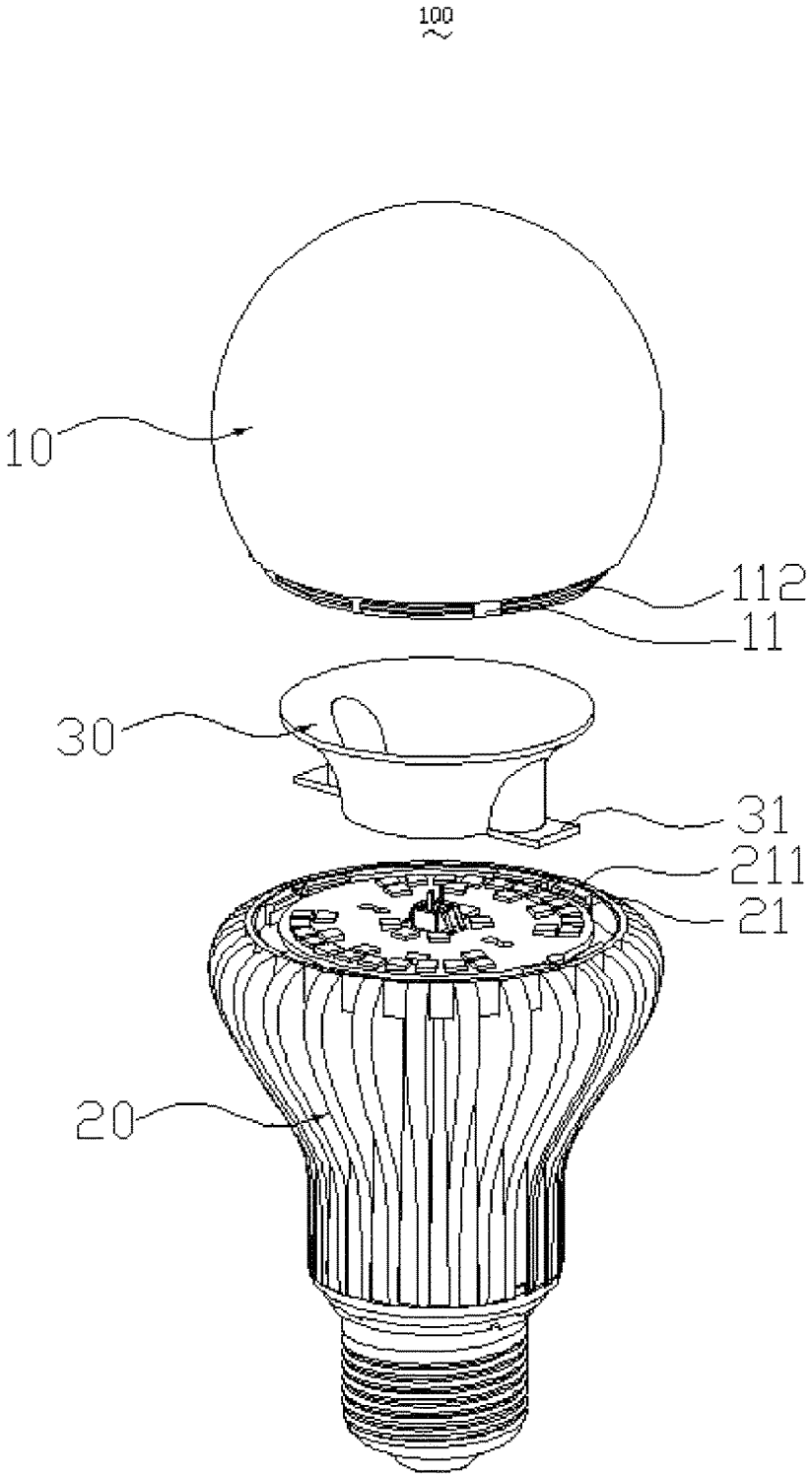
FIG. 3 is the stereoscopic decomposition drawing from FIG. 1 that illustrates the fixed structure of the light bulb shell.

The first embodiment of the present invention, the fixed structure of the light bulb shell (10), please refer to FIG. 1 to FIG. 3.

Please refer to FIG. 1 to FIG. 3. A fixed structure of the light bulb shell (10) includes a light source board (40), a light allocation item (30) and a light bulb shell (10). The light allocation item (30) is set on the light source board (40) to change the spread of the light comes out from the light source board (40). The light bulb shell (10) shade is set around the light source board (40) and the light allocation item (30). The bottom edge (11) is set on the opening site of the bottom of the light bulb shell (10). The bottom edge (11) is set around the light source board (40). The pressed device (31) is set on light allocation item (30). The pressed device (31) or the bottom edge (11) is made of the elastic ingredients. The pressed device (31) reaches to outside of the light source board (40) to press the bottom edge (11) of the light bulb shell (10).

Setting the bottom edge (11) through the bottom of the light bulb and setting the pressed device (31) on the light allocation item (30) make the pressed device (31) reach out the light board (40). Therefore, the pressed device (31) presses the bottom edge (11) of the light bulb shell (10) elastically to realize the stable and make the light bulb shell (10) be firmly installed. The fixed structure of the light bulb shell owns the advantage of being not easy to loose and simple structure. Among them, the pressed device (31) and the bottom edge (11) are made of elastic ingredients to make the pressed device (31) and the bottom edge (11) be free match and installed to install the light bulb shell (10) conveniently.

Please refer to FIG. 2 and FIG. 3. The bottom edge (11) of the light bulb shell (10) is the ring side structure and is set around the light board (40). The bottom edge (11) is set extended away from the light bulb shell (10). The inside of the bottom edge (11) of the light bulb shell (10) sets the bump (111). The pressed device (31) presses on the bump (111). Among them, setting the bottom edge (11) to be ring structure makes the whole shape structure of the light bulb shell (10) be more symmetry on one hand. On the other hand, setting the bottom edge (11) to be ring structure makes the bottom edge (11) be larger space, be convenient to set the installation of the firm structure and be sure to fix the light bulb shell (10) firmly. The inside of the bottom edge (11) matches the installation with the pressed device (31) through the bump (111) set on the side of inside. The fixed structure of the light bulb shell owns the advantages of the simple structure and the convenient installation.

Please refer to FIG. 2 and FIG. 3. The fixed structure of the light bulb shell includes the light body (20). The light source board (40) is fixed on the top of the light body (20). The light allocation item (30) is fixed above the light source board (40). The bottom edge (11) of the light bulb shell (10) is set between the pressed device (31) and the light body (20) of the light allocation item (30). The top of the light body (20) sets the situation slot (21). The bottom edge (11) of the light bulb shell (10) is stored in the situation slot (21) and relates to the situation slot (21). The outside of the bottom edge (11) of the light bulb shell (10) sets the positioning ring (112). The situation slot sets the buckle ring (211) relative to the positioning ring (112). The buckle ring (211) is buckled on the positioning ring (112).

Through setting the situation slot (21) on the light body (20), the buckle ring (211) on the situation slot, the relative positioning ring (112) on the outside of the light bulb shell (10) and buckling the positioning ring (112) on the buckle ring (211) realizes the firm installation. Therefore, the light bulb shell (10) is fixed on the light body (20) by the buckle to make the bottom edge (11) of the light bulb shell (10) set between the pressed device (31) and the light body (20) of the light allocation item (30). Promising the light bulb shell (10) to be firmly fixed on the light body (20) reduces the gluing process and owns the advantages of simple structure, convenient combination and not easy to loose.

Please refer to FIG. 2 and FIG. 3. The light allocation (30) is reflective ring. There are many LED light source set on the light source board (40) around the reflective ring. The reflective ring is used to reflect the light sent out from the LED light source toward the bottom of the light bulb shell (10). The light allocation item (30) is fixed on the light source board (40). The pressed device (31) is set on the bottom of the light allocation item (30).

In conclusion, through setting the bottom edge (11) on the bottom of the light bulb, setting the pressed item (31) on the light allocation item (30) reaches the pressed device (31) out of the light source board (40). Therefore, the pressed device (31) presses the bottom edge (11) of the light bulb shell (10) elastically to realize the firm and make the light bulb shell (10) be firmly installed. The inside of the bottom edge (11) of the light bulb shell (10) sets the bump (111). The pressed device (31) presses on the bump (111). The outside of the bottom edge (11) of the light bulb shell (10) sets the positioning ring (112). The situation slot sets the buckle ring (211) relative to the positioning ring (112). The buckle ring (211) is buckled on the positioning ring (112). Through setting the firm structure on the inside of the bottom edge (11) at the same time makes the bottom edge (11) of the light bulb shell (10) be set between the pressed device (31) and the light body (20) of the light allocation item (30). Promising the light bulb shell (10) may be firmly fixed on the light body (20) reduces the gluing process and owns the advantages of simple structure, convenient combination and not easy to loose.

It is understandable, the light source item (30) may be the structure of lens. Besides the light allocation item (30) is fixed on the light source board (40), the light allocation item may also be fixed on the light body (20). The light bulb shell (10) finally need the firm relative to the light body (20).

The statement above just for the better embodiment, not for limiting the present invention. All the modification, equal to any change and improvement that are based on the present invention's spirit and principle, may be protected in the present invention protection range.

The invention claimed is:

1. A light bulb with a fixed structure, the light bulb comprising:

a light source board;

a light allocation item; and a light bulb shell, wherein the light allocation item is set on the light source board to change the spread of the light coming out from the light source board, the light bulb shell is set around the light source board and the light allocation item, the light bulb shell has a bottom edge setting on a bottom of the light bulb shell, the bottom edge is set around the light source board, the light allocation item has a pressed device, the pressed device is made of an elastic ingredient, the pressed device reaches outside of the light source board forming an groove below the light allocation item for a portion of the bottom edge of the light shell to be inserted into the groove to press the bottom edge of the light bulb shell so that the portion of the bottom edge inserted into the groove and the pressed device form a fixing structure to fix the light shell to the light allocation item.

2. The light bulb shell with a fixed structure of claim 1, further comprising a light body wherein the light source board is fixed on a top of the light body, the light allocation item is fixed above the light source board; the bottom edge of the light bulb shell is set between the pressed device and the light body.

3. The light bulb shell with a fixed structure of claim 2, wherein the top of the light body sets a situation slot; the bottom edge of the light bulb shell is stored in the situation slot and connects to the situation slot.

4. The light bulb shell with a fixed structure of claim 3, wherein the bottom edge of the light bulb shell is a ring side structure and is set around the light board; the bottom edge is set extended away from the light bulb shell.

5. The light bulb shell with a fixed structure of claim 4, wherein the inside of the bottom edge of the light bulb shell has a bump; the pressed device presses on the bump.

6. The light bulb shell with a fixed structure of claim 4, wherein the outside of the bottom edge of the light bulb shell has a positioning ring; the situation slot sets the buckle ring relative to the positioning ring; the buckle ring is buckled on the positioning ring.

7. The light bulb shell with a fixed structure of claim 1, wherein the light allocation comprises a reflective ring; there are multiple LED light sources set on the light source board around the reflective ring; the reflective ring is used to reflect the light sent out from the LED light source toward the bottom of the light bulb shell.

8. The light bulb shell with a fixed structure of claim 7, wherein the light allocation item is fixed on the light source board; the pressed device is set on the bottom of the light allocation item.

* * * * *